US007275410B2

(12) United States Patent
Niigawa et al.

(10) Patent No.: US 7,275,410 B2
(45) Date of Patent: Oct. 2, 2007

(54) WORK TRANSFER DEVICE IN MULTI-PROCESS PRESS MACHINE

(75) Inventors: Kunio Niigawa, Nagoya (JP); Hideki Inoue, Nagoya (JP)

(73) Assignee: Takagi Manufacturing Co., Ltd., Aichi (JP)

( * ) Notice: Subject to any disclaimer, the term of this patent is extended or adjusted under 35 U.S.C. 154(b) by 59 days.

(21) Appl. No.: 11/353,260

(22) Filed: Feb. 14, 2006

(65) Prior Publication Data

US 2007/0022801 A1 Feb. 1, 2007

(30) Foreign Application Priority Data

Jul. 28, 2005 (JP) ..... 2005-218424

(51) Int. Cl.
*B21D 43/05* (2006.01)

(52) U.S. Cl. ..... 72/405.11; 72/405.1; 72/405.01; 198/621.3; 414/752.1

(58) Field of Classification Search ..... 72/405.01, 72/405.1, 405.11, 405.16, 405.12, 405.13, 72/421; 198/621.3, 621.1; 83/437.6; 100/207; 414/752.1, 751.1

See application file for complete search history.

(56) References Cited

U.S. PATENT DOCUMENTS 3,397,799 A * 8/1968 Wallis ..... 198/621.1
3,865,230 A * 2/1975 Nakada ..... 198/774.1
4,139,089 A * 2/1979 Jensen ..... 198/621.1

FOREIGN PATENT DOCUMENTS

JP 2504382 4/1996
JP 10-328766 12/1998

OTHER PUBLICATIONS

Patent Abstracts of Japan, Publication No. 10-328766, Publication Date Dec. 15, 1998, 2 pages.
Mechanical English Translation of Japanese Application No. 10-328766,A, 7 pages.
Patent Abstracts of Japan, Publication No. 07-164082, Publication Date Jun. 27, 1995, 2 pages.
Mechanical English Translation of Japanese Application No. 2504382,B, 16 pages.

* cited by examiner

*Primary Examiner*—Daniel C Crane
(74) *Attorney, Agent, or Firm*—Osha Liang LLP

(57) ABSTRACT

A work transfer device employed in a multi-process press machine is provided with a drive unit formed of a servo motor, a cam shaft vertically provided so as to be rotatably driven by the drive unit, a cam mechanism formed of three cams including an X-axis feed cam that moves a feed bar provided with a work holding fitting for holding a work toward an X-axis direction, a Y-axis feed cam that moves the feed bar in parallel toward a Y-axis direction in parallel, and a Z-axis feed cam that moves the feed bar in parallel toward a Z-axis direction, a group of swing levers formed of three types of swing levers which are swingably operated in engagement with the corresponding cams that constitute the cam mechanism, and a link mechanism connected to each end portion of the swing levers such that the feed bar is linearly driven toward the X-axis, Y-axis, and Z-axis directions.

2 Claims, 5 Drawing Sheets

WORK TRANSFER DEVICE IN MULTI-PROCESS PRESS MACHINE

INCORPORATION BY REFERENCE

The disclosure of Japanese Patent Application No. 2005-218424 filed on Jul. 28, 2005, including its specification, drawings and abstract, is incorporated herein by reference in its entirety.

BACKGROUND OF THE INVENTION

1. Field of the Invention

The present invention relates to a work transfer device which is employed in a multi-process press machine combined with a plurality of metal mold sets for sequentially transferring the work from one process step to another.

2. Description of Related Art

A generally employed work transfer device has been disclosed in Patent Publication No. 2504382, for example. The disclosed device is structured such that the feed bar to which the work suction fitting (holding fitting) is attached is moved two dimensionally, that is, longitudinal direction and lateral direction on the vertical plane including the work transfer direction such that the work is sequentially transferred from one process step to another. The aforementioned two dimensional movement of the feed bar is performed by two cams. Meanwhile Japanese Patent Application Laid-Open No. 10-328766 discloses the transfer press carrying device structured to move the work suction fitting (holding fitting) three-dimensionally in X-axis,Y-axis, and Z-axis directions such that the work transfer may be performed more smoothly at higher rates.

The transfer press carrying device in which the work is three-dimensionally transferred as disclosed in Japanese Patent Application Laid-Open No. 10-328766 is provided with a plurality of servo motors, a position detection sensor, an encoder, and a controller that execute predetermined computing operations based on data detected by various detection units as described above such that the work suction fitting (holding fitting) is moved to a predetermined position based on the computed result. Accordingly, the resultant structure of the device for the work transfer becomes complicated and large in size.

SUMMARY OF THE INVENTION

It is an object of the invention to provide a work transfer device with simplified structure in which three cams are arranged around a vertically provided shaft rotated by a single motor such that the work suction fitting (holding fitting) is three-dimensionally moved by operating those cams.

A work transfer device employed in a multi-process press machine for sequentially transferring a work from one process step to another is provided with a drive unit that is operated synchronously with an operation of the multi-process press machine for moving a metal die thereof up and down, a cam shaft provided vertically with respect to a horizontal plane, which is rotatably driven by the drive unit and has a plurality of cams coaxially attached thereto, a cam mechanism attached to the cam shaft so as to be operated on the horizontal plane, which is formed of three cams including an X-axis feed cam that serves to move a feed bar provided with a work holding fitting for holding the work toward its longitudinal direction as an X-axis direction, a Y-axis feed cam that moves the feed bar toward a Y-axis direction perpendicular to the X-axis direction in parallel on the same plane as that of the X-axis feed cam, and a Z-axis feed cam that serves to move the feed bar in parallel toward a direction vertical to the horizontal plane as a Z-axis direction, three types of swing levers each having a cam follower engaged with each of the cams that constitute the cam mechanism in an intermediate portion of the respective swing levers so as to be swingably operated at predetermined support points, and a link mechanism connected to each end portion of the swing levers so as to drive the feed bar toward one of the X-axis direction, the Y-axis direction, and the Z-axis direction.

The work transfer device according to the invention is structured such that the swing levers engaged with the Y-axis feed cam are formed of two swing levers so as to form a symmetrical pantograph-like arrangement with respect to the center of the cam shaft on the horizontal plane, and to be swingably operated at the predetermined support points, and end portions of the two swing levers are connected to end portions of rods each having a substantially same length so as to be rotatably operated, and the other end portions of the rods are connected to a portion for supporting the feed bar slidably moving on a rail provided in the Y-axis direction so as to be rotatably operated.

According to the invention, the work transfer device of the present invention is structured to have three cams attached to the vertically provided cam shaft rotated by the single motor such that those cams are operated on the horizontal plane. The work transfer device may be formed to be compact enough to be accommodated in the limited space. The link mechanism formed of rods and levers, for example, is connected to the corresponding cams such that the feed bar to which the work holding fitting is attached is linearly driven three-dimensionally through the link mechanism. Accordingly, the work transfer to the subsequent process step may be efficiently and smoothly performed.

According to the invention, the swing lever for moving the feed bar in the Y-axis direction on the horizontal plane is formed of two swing levers that interpose the Y-axis feed cam therebetween for forming the pantograph-like arrangement. The rods are rotatably connected to each end portion of the swing levers. The end portion of the rod is further rotatably connected to the member that slidably moves on the rail provided along the Y-axis direction while supporting the feed bar. This makes it possible to smoothly move the feed bar with a long length to which a plurality of suction fittings (holding fittings) are attached toward the Y-axis direction while being kept horizontal.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DESCRIPTION OF THE PREFERRED EMBODIMENTS

Figure 1:
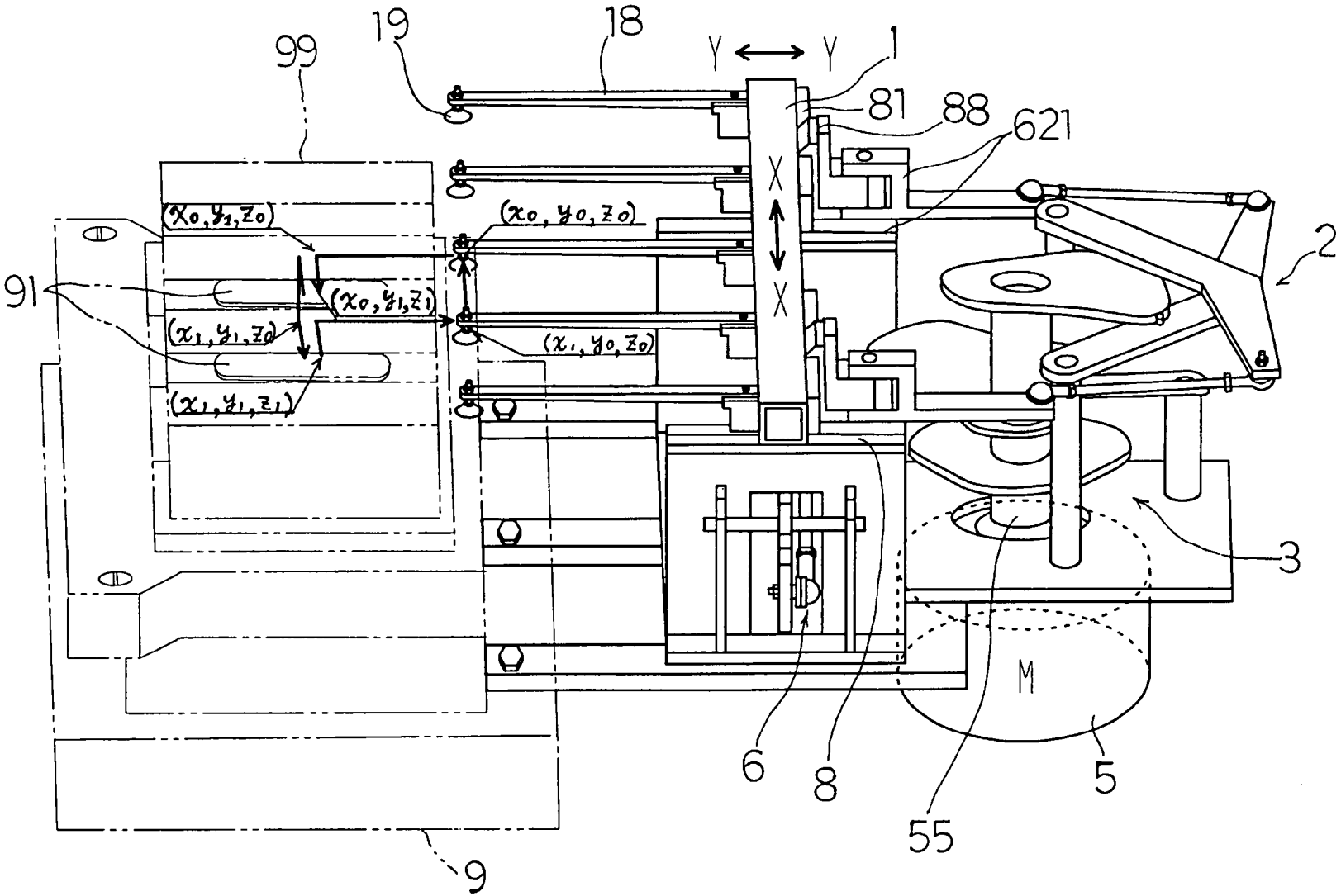
FIG. 1 is a perspective view schematically showing a structure of a work transfer device according to the present invention.

A preferred embodiment of the present invention will be described referring to FIGS. 1 to 5. The work transfer device according to the embodiment is employed in a multi-process press machine 9 combined with a plurality of mold sets 99, 99 such that a work 91 is sequentially transferred from one process step to another as shown in FIG. 1. More specifically, the work transfer device is provided with a drive unit 5 formed as a servo motor or the like which is operated in synchronization with the operation of the press machine 9 for lifting the mold up and down, a cam shaft 55 disposed vertical to the horizontal plane and rotatably driven by the drive unit 5, to which a plurality of cams are coaxially attached, a cam mechanism 3 assembled with the cam shaft 55 so as to be operated on the horizontal plane, which is formed of an X-axis feed cam 31 for transferring a feed bar 1 including a work suction fitting (holding fitting) 19 that holds the work 91 in the X-axis direction as the longitudinal direction of the feed bar 1, a Y-axis feed cam 32 for transferring the feed bar 1 in the Y-axis direction in parallel perpendicular to the X-axis direction on the same plane surface, and a Z-axis feed cam 33 for transferring the feed bar 1 up and down in the Z-axis direction in parallel vertical to the horizontal plane, three types of swing levers 2 each having a cam follower engaged with the corresponding cams 31, 32, 33 that constitute the cam mechanism 3 in the intermediate portion, which swing around predetermined supporting points, and a link mechanism 6 connected to each end portion of the respective levers that constitute the swing levers 2, which is structured to linearly drive the feed bar 1 in either of the X-axis direction, the Y-axis direction, or the Z-axis direction.

Figure 2:
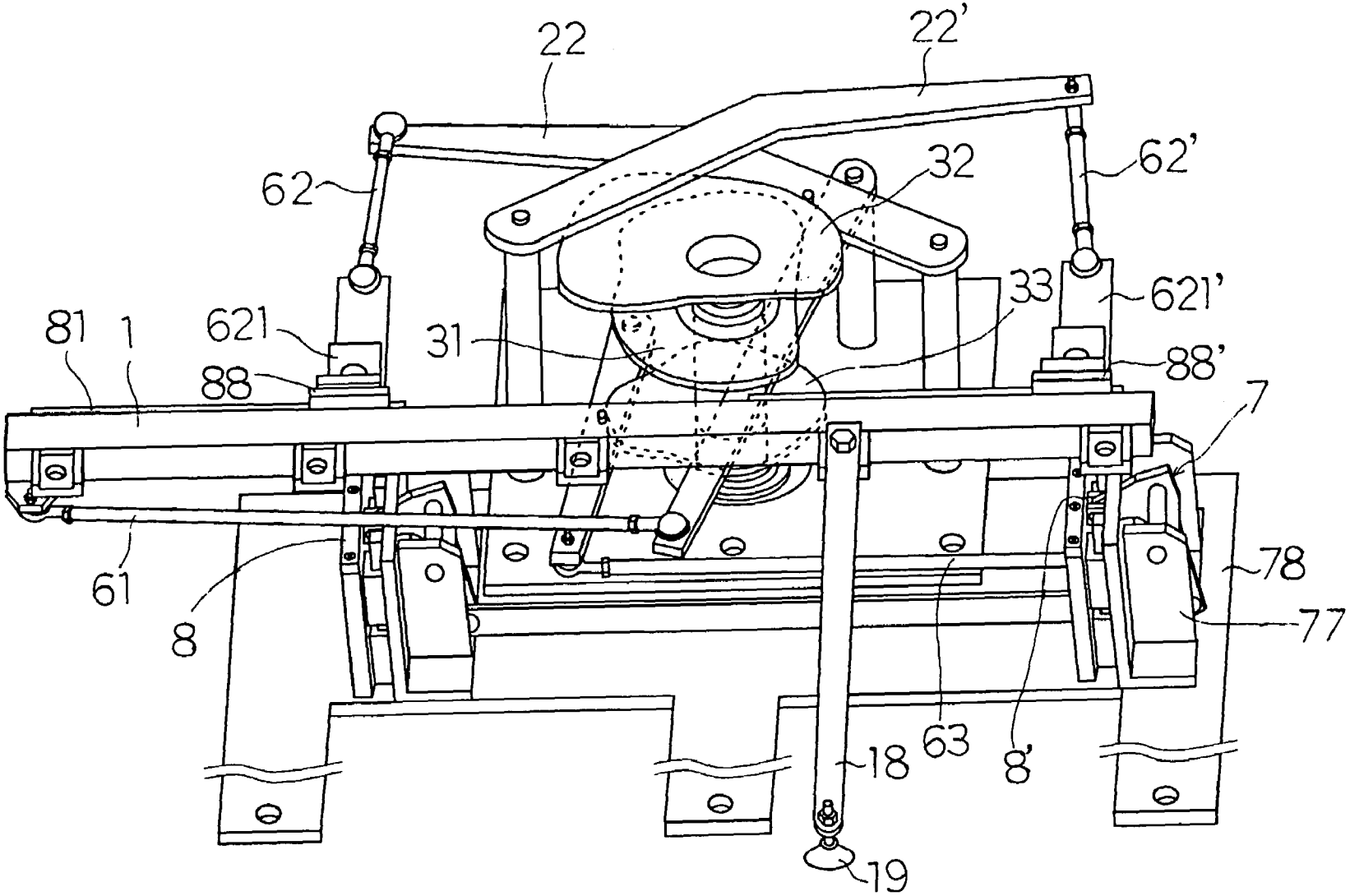
FIG. 2 is a perspective view schematically showing a structure of a cam mechanism, swing levers, and a link mechanism as main parts of the work transfer device according to the present invention.

Referring to FIG. 1, the feed bar 1 is provided with a plurality of fingers 18 at its one side surface, each end portion of which is provided with a suction fitting (holding fitting) 19 for holding the work. The above-described feed bar 1 with a long length is structured to move on Y-axis rails 8, 8' toward the X-axis and Y-axis directions as shown in FIG. 2. The Y-axis rails 8, 8' are driven up and down by the cam mechanism 3, the swing levers 2 engaged with the cam mechanism 3, and the link mechanism 6 connected to the corresponding swing levers that constitute the swing levers 2 (to be described later) (see FIG. 1).

The cam mechanism 3 serving as the drive source for driving the feed bar 1 three-dimensionally in the X-axis direction, Y-axis direction, and Z-axis direction will be described referring to FIGS. 1 and 2. The cam mechanism 3 is rotatably driven by the drive unit 5 formed of the servo motor or the like, and formed of three cams 31, 32, 33 assembled with the single cam shaft 55 vertically disposed to the horizontal plane. More specifically the cam mechanism 3 is formed of the X-axis feed cam 31 structured to linearly drive the feed bar 1 in the X-axis direction as the longitudinal direction of the feed bar 1, the Y-axis feed cam 32 structured to drive the feed bar 1 in the Y-axis direction perpendicular to the X-axis direction on the same plane surface, and the Z-axis feed cam 33 structured to drive the feed bar 1 in the Z-axis direction vertical to the horizontal plane. Each cam profile of those cams 31, 32, 33 is formed on the horizontal plane in the direction perpendicular to the cam shaft 55. A cam groove is formed at the cam profile so as to be brought into engagement with the cam follower provided on the respective swing levers (described later). Each of the cams 31, 32, and 33 is formed of a plane cam provided with the cam groove so as to have a predetermined configuration.

Figure 3:
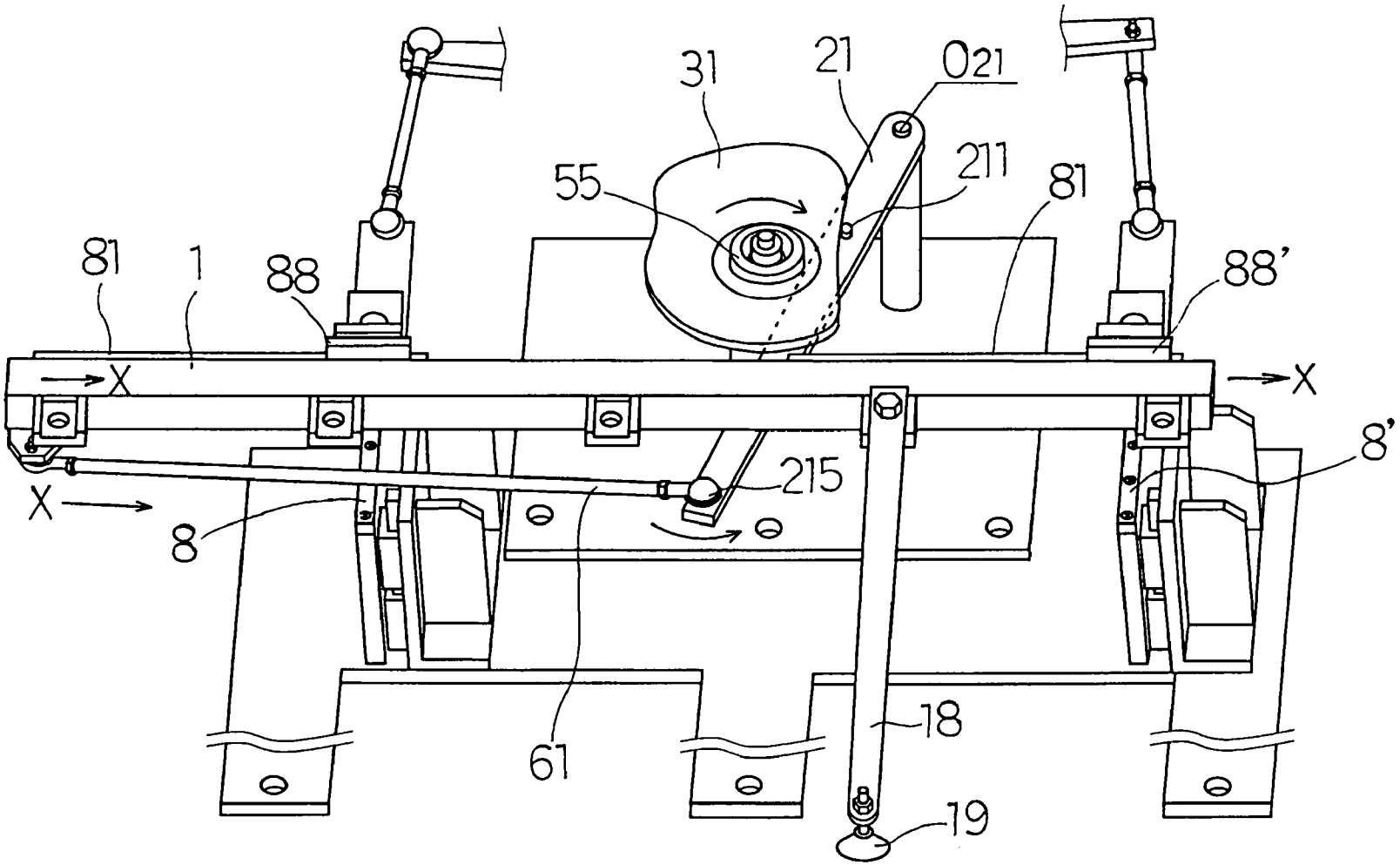
FIG. 3 is a perspective view schematically showing a structure of an X-axis feed cam, and the swing levers and the link mechanism which are operated in association with the operation of the X-axis feed cam.

The swing levers 2 respectively brought into engagement with the cams 31, 32, 33 each having the aforementioned cam profile will be described referring to FIGS. 2 to 5. An explanation with respect to a swing lever (hereinafter referred to as a first swing lever) 21 that is engaged with the X-axis feed cam 31 will be described referring to FIG. 3. As shown in FIG. 3, the first swing lever 21 is supported by a point $O_{21}$ at its end portion so as to be swingable thereat. A cam follower 211 formed at the intermediate portion of the first swing lever 21 is brought into engagement with the cam profile portion of the X-axis feed cam 31 so as to restrict the swinging operation of the first swing lever 21. An end portion 215 of the first swing lever 21 having the cam follower 211 at its intermediate portion is connected to an end portion of a first rod 61 so as to be rotatably operated. The other end portion of the first rod 61 is connected to the feed bar 1 so as to be rotatably operated.

As the X-axis feed cam 31 is operated, the first swing lever 21 starts swinging such that the feed bar 1 is linearly driven in its longitudinal direction, that is, the X-axis direction via the first rod 61. More specifically as the feed bar 1 is integrally provided with an X-axis rail 81 at its lower portion, the feed bar 1 is driven toward the X-axis direction on the Y-axis rails 8, 8' guided by the X-axis guides 88, 88' together with the X-axis rail 81. The linear movement of the feed bar 1 toward the X-axis direction allows the work suction fitting (hold fitting) 19 attached to the feed bar 1 via the finger 18 to be linearly driven in the X-axis direction. The work 91, thus, can be transferred toward the X-axis direction.

Figure 4:
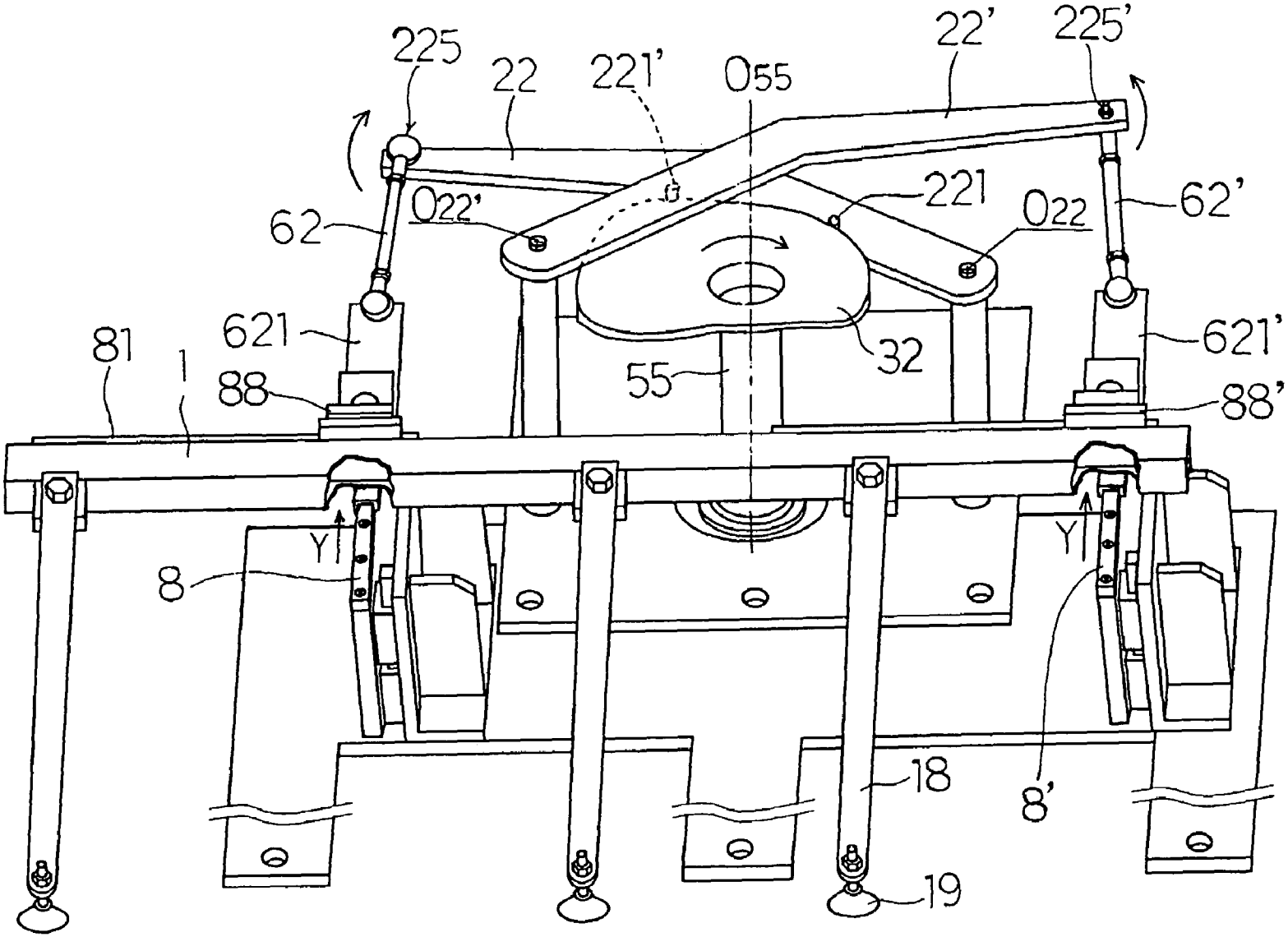
FIG. 4 is a perspective view schematically showing a structure of a Y-axis feed cam, and the swing levers and the link mechanism which are operated in association with the operation of the Y-axis feed cam.

The explanation with respect to the second swing levers 22, 22' that constitute the swing levers 2 engaged with the Y-axis feed cam 32 will be described referring to FIGS. 2 and 4. As shown in FIGS. 2 and 4, the second swing levers 22, 22' are provided to form an X-like arrangement symmetrical to the center axis $O_{55}$ of the cam shaft 55. More specifically the second swing levers 22, 22', respectively supported at points $O_{22}$, $O_{22'}$, are symmetrically arranged with respect to the center axis $O_{55}$ of the cam shaft 55 on the horizontal plane. The swing levers 22, 22' are provided with cam followers 221, 221' at the intermediate portions, respectively. Those cam followers 221, 221' are brought into engagement with the cam profile portion of the Y-axis feed cam 32. End portions 225, 225' of the swing levers 22, 22' which are provided to form the symmetrical X-like arrangement on the horizontal plane, that is, the pantograph-like arrangement are connected to the second rods 62, 62' in parallel with each other so as to have the respective end portions rotatably operated. The other end portions of those second rods 62, 62' are connected to Y-axis sliders 621, 621' which are slidably moveable toward the Y-axis direction on the Y-axis rails 8, 8', respectively. The Y-axis sliders 621, 621' are connected to the X-axis guides 88, 88' so as to be swingably operated, respectively.

In the above-structured device, when the Y-axis feed cam 32 starts rotating toward a predetermined direction, the left and right second swing levers 22, 22' which are pantograph-like arranged via the cam followers 221, 221' engaged with a portion formed on the cam profile portion of the Y-axis feed cam 32, for example, cam groove, are swingably operated synchronously. The left and right second rods 62, 62' connected to the end portions 225, 225' of the second levers 22, 22', and the Y-axis sliders 621, 621' which are respectively in parallel with each other are linearly moved in the axial direction of the second rods 62, 62'. Accordingly the Y-axis sliders 621, 621' and the X-axis guides 88, 88' are linearly moved toward the Y-axis direction. The feed bar 1 is linearly driven on the left and right Y-axis rails 8, 8' toward the Y-axis direction. The work holding fitting 19 attached to the feed bar 1 via the finger 18 is linearly driven toward the Y-axis direction.

Figure 5:
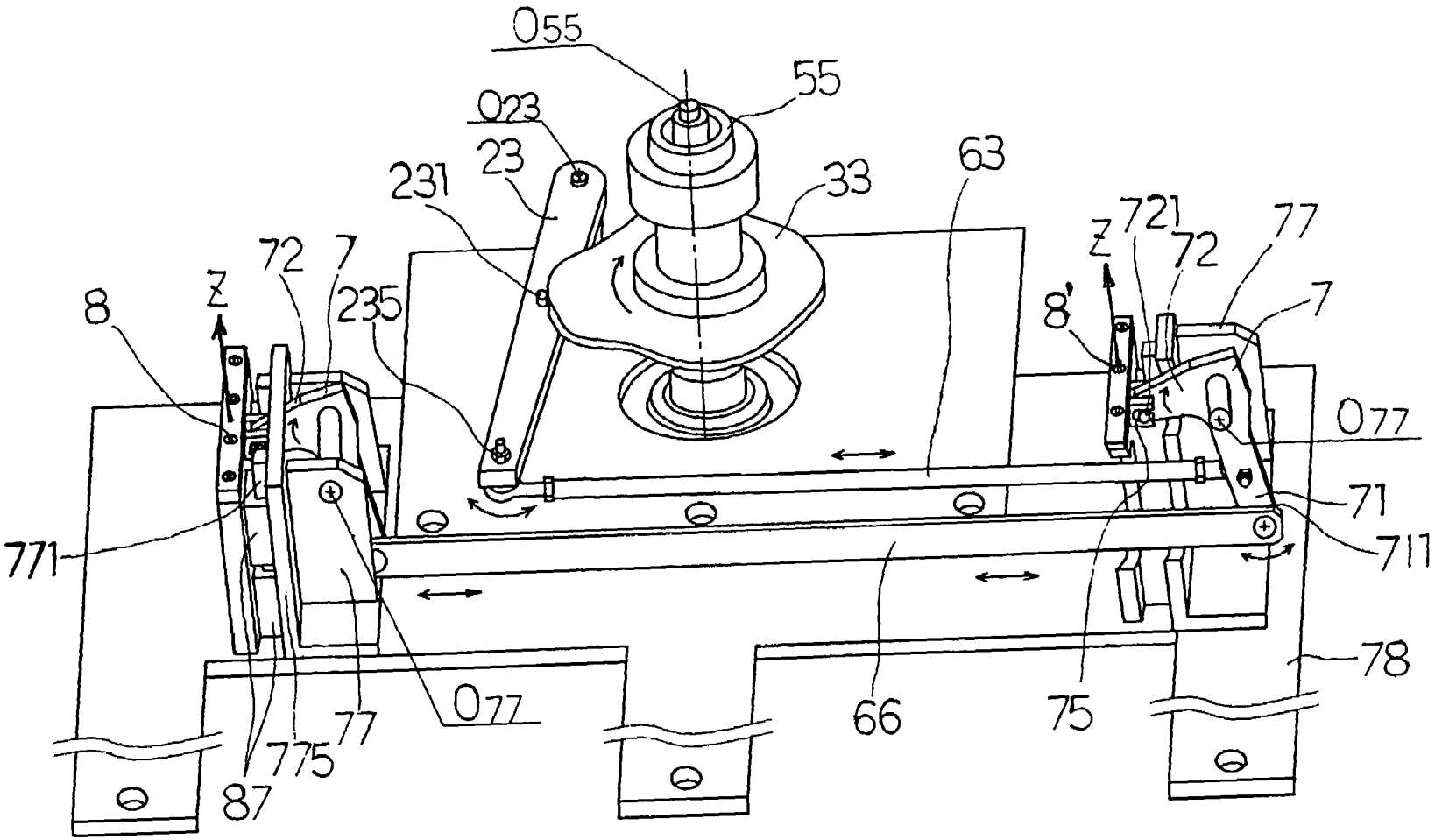
FIG. 5 is a perspective view schematically showing a structure of a Z-axis feed cam, and the swing levers and the link mechanism which are operated in association with the operation of the Z-axis feed cam.

The explanation of the third swing lever 23 engaged with the Z-axis feed cam 33 will be described referring to FIGS. 2 and 5. The third swing lever 23 is supported at a point $O_{23}$ so as to be swingably operated as shown in FIG. 5. The third swing lever 23 is provided with a cam follower 231 at the intermediate portion thereof, which is brought into engagement with a portion, for example, a cam groove formed on the cam profile portion of the Z-axis feed cam 33. The operation of the cam follower 231 along the cam groove may restrict the swinging operation of the third swing lever 23. An end portion 235 of the third swing lever 23 is connected to a third rod 63 having its end portion rotatably operated. The other end portion of the third rod 63 is rotatably connected to the center portion of a long leg portion 71 of an inverse L-like arm 7 so as to be rotatably operated on a stay 77 formed on a base 78. The operation of the L-like arm 7 allows the Y-axis rails 8, 8' that support the feed bar 1 to be driven toward the Z-axis direction, that is, the direction vertical to the horizontal plane.

The explanation with respect to a lifting mechanism mainly formed of the L-like arm 7 for moving the Y-axis rails 8, 8' up and down will be described referring to FIG. 5. The inverse L-like arm 7 is supported at the stay 77 so as to be rotatably operated around a bent point $O_{77}$ between the long leg portion 71 and a short leg portion 72. In other words, the L-like arm 7 is provided so as to be swingably operated around the point $O_{77}$ on the plane vertical to the horizontal plane. The center portion of the long leg portion 71 that constitutes the L-like arm 7 is connected to one end portion of the third rod 63 so as to be rotatably operated. An end portion 721 of the short leg portion 72 of the L-like arm 7 is provided with a shoe 75 through which the end portion 721 of the short leg portion 72 of the L-like arm 7 is connected to the Y-axis rails 8, 8', respectively. More specifically a side plate 775 of the stay 77 attached to the L-like arm 7 is provided with a Z-axis rail 771 in the direction vertical to the horizontal plane. The Z-axis rail 771 is engaged with a Z-axis guide 87 integrally provided with each side surface of the Y-axis rails 8, 8'. The Y-axis rails 8, 8' are slidably operated up and down along the Z-axis rails 771. When the end portion 721 of the short leg portion 72 is operated up and down accompanied with the swinging operation of the L-like arm 7 on the plane vertical to the horizontal plane, such movement is transferred to the Y-axis rails 8, 8' via the shoes 75. The Y-axis rails 8, 8' are, thus, linearly driven up and down. The end portion 711 of the long leg portion 71 of the L-like arm 7 is connected to the connecting rod 66 such that the linear movement of the third rod 63 is transferred in synchronization with the left and right L-like arms 7, 7.

The operation of the above-structured work transfer device according to the embodiment will be described hereinafter. Referring to FIG. 1, when the drive unit 5 formed of the servo motor or the like is actuated in synchronization with the operation of the mold set 99 combined with the press machine 9, the vertically provided cam shaft 55 starts its rotating operation. The rotating operation of the cam shaft 55 is transferred as the rotating operations of three cams 31, 32, 33 attached to the cam shaft 55. The swing levers 21, 22, 22', 23 start swinging via the cam followers 211, 221, 221', 231 engaged with the cam profile portions of the cams 31, 32, 33, respectively. The swinging operations of those swing levers 21, 22, 22', 23 linearly drive the feed bar 1 in the X-axis direction, Y-axis direction, and Z-axis direction through the operation of the link mechanism 6 connected to the respective end portions of the swing levers 21, 22, 22', 23. Accordingly the plurality of work suction fittings (holding fittings) 19 attached to the feed bar 1 via the fingers 18 are linearly driven in the X-axis direction, Y-axis direction, and Z-axis direction, respectively. The work holding fitting 19 is operated to sequentially transfer the work 91 from the present process step to the subsequent process step.

The explanation with respect to the movement of the feed bar 1 and the work suction fitting (holding fitting) 19 toward the respective directions will be described hereinafter. The movement toward the Y-axis direction in the first stage of the operation will be described referring to FIGS. 1 and 4. As shown in FIG. 4, when the Y-axis feed cam 32 starts rotating, the left and right second swing levers 22, 22' provided to form the pantograph-like arrangement are swingably operated in synchronization with the rotation of the Y-axis feed cam 32 through the cam followers 221, 221' engaged with the cam profile portions of the Y-axis feed cam 32. The aforementioned swinging operation allows the left and right second rods 62, 62' connected to the respective end portions 225, 225', and the Y-axis sliders 621, 621' to be linearly operated respectively in parallel with each other on the Y-axis rails 8, 8'. As a result, the feed bar 1 swingably attached to the Y-axis sliders 621, 621' via the X-axis guides 88, 88' may be linearly driven in the Y-axis direction on the Y-axis rails 8, 8'. Accordingly the work suction fitting (holding fitting) 19 attached to the feed bar 1 via the finger 18 may be linearly driven in the Y-axis direction. The work holding fitting 19 is, thus, moved to the position above the work 91 set on the mold set 99. That is, the work holding fitting 19 moves from its original position (coordinate) of $(x_0, y_0, z_0)$ to the position (coordinate) of $(x_0, y_1, z_0)$.

The second stage of the operation will be described referring to FIG. 5. The second stage of the operation starts upon the rotating operation of the Z-axis feed cam 33. The third swing lever 23 starts swinging upon the rotating operation of the Z-axis feed cam 33 via the operation of the cam follower 231 engaged with the cam profile portion of the Z-axis feed cam 33. The swinging operation of the third lever 23 moves the third rod 63 in its axial direction. The left and right L-like arms 7 start swinging on the plane vertical to the horizontal plane upon the movement of the third rod 63 and the operation of the connecting rod 66. The swinging operation of the L-like arm 7 on the vertical plane allows the shoe 75 attached to the end portion 721 of the short leg portion 72 that constitutes the L-like arm 7 to be moveable up and down. Through the vertical movement of the shoe 75, the left and right Y-axis rails 8, 8' move up and down along the Z-axis rail 771 attached to the side plate 775 of the stay 77. This may allow the feed bar 1 and the work suction fitting (holding fitting) 19 attached thereto via the finger 18 are driven toward the Z-axis direction vertical to the horizontal plane. In the embodiment, the work holding fitting 19 is moved down from the position above the work 91, more specifically, from the position at the coordinate $(x_0, y_1, z_0)$ to the position at the coordinate ($x_0$, $y_1$, $z_1$). In the aforementioned state, the work 91 is suction fit (held) to the work holding fitting 19. Holding the work 91, the work holding fitting 19 is lifted up through the operations of the third swing lever 23, the third rod 63 and the L-like arm 7 resultant from the rotating operation of the Z-axis feed cam 33. That is, the work holding fitting 19 which holds the work 91 is lifted up from the position at the coordinate ($x_0$, $y_1$, $z_1$) to the position at the coordinate ($x_0$, $y_1$, $z_0$).

The third stage of the operation for transferring the work 91 will be described. This stage is performed when the swinging operation of the first swing lever 21 starts accompanied with the operation of the X-axis feed cam 31. In other words, the swinging operation of the first swing lever 21 is transferred to the feed bar 1 via the first rod 61 connected to the end portion 215 of the first swing lever 21. The feed bar 1 is then linearly driven in its axial direction, that is, X-axis direction. More specifically the feed bar 1 is slidably moved together with the X-axis rail 81 guided by the X-axis guides 88, 88'. The linear movement of the feed bar 11 in the X-axis direction serves to drive the work suction fitting (holding fitting) 19 attached to the feed bar 1 via the finger 18 toward the X-axis direction. Finally the work 91 is transferred toward the X-axis direction. That is, the work holding fitting 19 which holds the work 91 is transferred from the position at the coordinate ($x_0$, $y_1$, $z_0$) to the position at the coordinate ($x_1$, $y_1$, $z_0$).

In the aforementioned state, the fourth stage for the transfer of the work in the vertical Z-axis direction is started in the same way as the second stage. Likewise the second stage, this stage is performed through the rotating operation of the Z-axis feed cam 33, the swinging operation of the third swing lever 23, the linear movement of the third rod 63 in the axial direction, the linear movement of the connecting rod 66, the swinging operation of the L-like arm 7 on the plane vertical to the horizontal plane, and the lifting operation of the Y-axis rails 8, 8' via the shoe 75. In the embodiment, the work holding fitting 19 which holds the work 91 that has been transferred to the position above the mold set 99 is moved down. That is, the work holding fitting 19 is moved from the position at the coordinate ($x_1$, $y_1$, $z_0$) to the position at the coordinate ($x_1$, $y_1$, $z_1$). The work 91 is removed from the work holding fitting 19 so as to be set on the mold set 99. The work holding fitting 19 from which the work 91 is removed, and the feed bar 1 are moved up in the procedure reverse to the one as described above. That is, the work holding fitting 19 is lifted from the position at the coordinate ($x_1$, $y_1$, $z_1$) to the position at the coordinate ($x_1$, $y_1$, $z_0$). A series of those steps are performed through the operation of the third swing lever 23 engaged with the Z-axis feed cam 33, the operations of the third rod 63, the connecting rod 66, and further the L-like arms 7 accompanied with the operation of the third swing lever 23.

The fifth stage for moving the work holding fitting 19 from which the work 91 has been removed to the position so as not to interfere with the operation of the press machine 9 upon completion of the transfer of the work 91 to the subsequent process step will be described. This stage is done by performing the procedure inverse to that of the first stage. That is, two swing levers 22, 22' provided to form the pantograph-like arrangement are swingably operated by the operation of the Y-axis feed cam 32, and accordingly the second rods 62, 62' provided on the end portions 225, 225' of the second swing levers 22, 22' are linearly moved in the axial directions. As a result, the feed bar 1 is linearly driven on the Y-axis rails 8, 8' in the Y-axis direction. That is, the present stage is performed such that the feed bar 1 is retracted to be brought into the original position. The work suction fitting (holding fitting) 19 attached to the feed bar 1 via the finger 18 is also retracted to the position deviated from the path of the vertical operation of the mold set 99 combined with the press machine 9. That is, the work suction fitting (holding fitting) 19 is moved from the position at the coordinate ($x_1$, $y_1$, $z_0$) to the position at the coordinate ($x_1$, $y_0$, $z_0$).

The sixth stage for returning the feed bar 1 to the original start position will be described. This stage is done by performing the procedure inverse to that of the third stage. More specifically, the rotating operation of the X-axis feed cam 31 swingably moves the first swing lever 21 such that the first rod 61 is linearly operated in its axial direction. Accordingly the feed bar 1 linearly moves toward the X-axis direction guided by the X-axis guides 88, 88' together with the X-axis rail 81. In other words, the feed bar 1 is moved to return to its original start position. As a result, the work suction fitting (holding fitting) 19 attached to the feed bar 1 via the finger 18 is returned from the position at the coordinate ($x_1$, $y_0$, $z_0$) to the first position at the coordinate ($x_0$, $y_0$, $z_0$).

The work transfer device of the embodiment is rotatably driven by a single unit of a motor. It is provided with three cams 31, 32, 33 each operated at the vertically provided cam shaft 55 on the horizontal plane such that the work 91 is transferred. This makes it possible to have the work transfer device compact enough to be accommodated in the limited space. The work transfer device is provided with the three types of the swing levers 21, 22(22'), 23 each engaged with the corresponding cams 31, 32, 33, and the link mechanism 6 formed of the rods 61, 62, 63 connected to the corresponding swing levers, through which the feed bar 1 to which the work holding fitting 19 is attached is linearly driven three-dimensionally. This makes it possible to transfer the work 91 to the subsequent process more efficiently and smoothly.

In the work transfer device, the swing lever moveable toward the Y-axis direction on the horizontal plane is formed of the two swing levers 22, 22' which interpose the Y-axis feed cam 32 therebetween to form the pantograph-like arrangement, and the end portions 225, 225' of the respective swing levers 22, 22' are connected to the second rods 62, 62' and the Y-axis sliders 621, 621'. The Y-axis sliders 621, 621' are provided so as to be slidably moved toward the Y-axis direction on the Y-axis rails 8, 8'. The feed bar 1 with a long length to which a plurality of work suction fittings (holding fittings) 19 are attached may be smoothly transferred toward the Y-axis direction while being kept in parallel.

What is claimed is:

1. A work transfer device employed in a multi-process press machine for sequentially transferring a work from one process step to another, comprising:

a drive unit that is operated synchronously with an operation of the multi-process press machine for moving a metal die thereof up and down;

a cam shaft provided vertically with respect to a horizontal plane, which is rotatably driven by the drive unit and has a plurality of cams coaxially attached thereto;

a cam mechanism attached to the cam shaft so as to be operated on the horizontal plane, which is formed of three cams including an X-axis feed cam that serves to move a feed bar provided with a work holding fitting for holding the work toward its longitudinal direction as an X-axis direction, a Y-axis feed cam that moves the feed bar toward a Y-axis direction perpendicular to the X-axis direction in parallel on the same plane as that of the X-axis feed cam, and a Z-axis feed cam that serves to move the feed bar in parallel toward a direction vertical to the horizontal plane as a Z-axis direction;

three types of swing levers each having a cam follower engaged with each of the cams that constitute the cam mechanism in an intermediate portion of the respective swing levers so as to be swingably operated at predetermined support points; and a link mechanism connected to each end portion of the swing levers so as to drive the feed bar toward one of the X-axis direction, the Y-axis direction, and the Z-axis direction.

2. The work transfer device according to claim 1, wherein:

the swing levers engaged with the Y-axis feed cam are formed of two swing levers so as to form a symmetrical pantograph-like arrangement with respect to the center of the cam shaft on the horizontal plane, and to be swingably operated at the predetermined support points; and end portions of the two swing levers are connected to end portions of rods each having a substantially same length so as to be rotatably operated, and the other end portions of the rods are connected to a portion for supporting the feed bar slidably moving on a rail provided in the Y-axis direction so as to be rotatably operated.

* * * * *